US011771247B1

(12) United States Patent
Gillquist

(10) Patent No.: US 11,771,247 B1
(45) Date of Patent: Oct. 3, 2023

(54) DUVET AND DUVET COVER

(71) Applicant: Down for Good LLC, Lakeville, MN (US)

(72) Inventor: Natalie Gillquist, Lakeville, MN (US)

(73) Assignee: Down for Good LLC, Lakeville, MN (US)

( * ) Notice: Subject to any disclaimer, the term of this patent is extended or adjusted under 35 U.S.C. 154(b) by 99 days.

(21) Appl. No.: 16/134,461

(22) Filed: Sep. 18, 2018

Related U.S. Application Data

(60) Provisional application No. 62/560,399, filed on Sep. 19, 2017.

(51) Int. Cl.
*A47G 9/02* (2006.01)
*A47G 9/10* (2006.01)
*A47G 9/04* (2006.01)

(52) U.S. Cl.
CPC ..... *A47G 9/0261* (2013.01); *A47G 9/0207* (2013.01); *A47G 9/04* (2013.01); *A47G 9/1045* (2013.01)

(58) Field of Classification Search
CPC ..... A47G 9/0261; A47G 9/0207; A47G 9/04; A47G 9/1045
See application file for complete search history.

(56) References Cited

U.S. PATENT DOCUMENTS

| | | | | |
|---|---|---|---|---|
| 3,241,161 | A | 3/1966 | Dashosh | |
| 8,458,832 | B1 | 6/2013 | Krishna | |
| 8,756,730 | B2 | 6/2014 | MacDonald | |
| 2005/0011618 | A1 | 1/2005 | Kee | |
| 2011/0023235 | A1 | 2/2011 | Gold | |
| 2013/0152306 | A1 | 6/2013 | Monaco | |
| 2015/0157147 | A1 | 6/2015 | Haraszta | |
| 2015/0282645 | A1 | 10/2015 | Sorgeloos | |
| 2016/0192793 | A1 | 7/2016 | Cavosie et al. | |
| 2016/0220047 | A1* | 8/2016 | Stang | A47G 9/0253 |
| 2017/0127855 | A1 | 5/2017 | Wootten, Jr. | |
| 2018/0027998 | A1* | 2/2018 | Heiman et al. | A47G 9/0207 |
| 2018/0303257 | A1* | 10/2018 | Alletto, Jr. | A47G 9/0253 |

FOREIGN PATENT DOCUMENTS

| | | | |
|---|---|---|---|
| CN | 102078112 | A | 6/2011 |
| CN | 202408086 | U | 9/2012 |
| EP | 2 774 514 | A1 | 9/2014 |
| WO | 2011146982 | A1 | 12/2011 |

* cited by examiner

*Primary Examiner* — David R Hare
*Assistant Examiner* — Adam C Ortiz
(74) *Attorney, Agent, or Firm* — AVEK IP, LLC

(57) ABSTRACT

A duvet in combination with two duvet covers, in which one duvet cover acts as a top cover layer to the duvet and a second duvet cover acts as a bottom cover layer to the duvet, where both attached to the perimeter of a duvet, wherein the top and bottom layers of the duvet cover are not attached to each other, but only to the perimeter of the duvet.

8 Claims, 10 Drawing Sheets

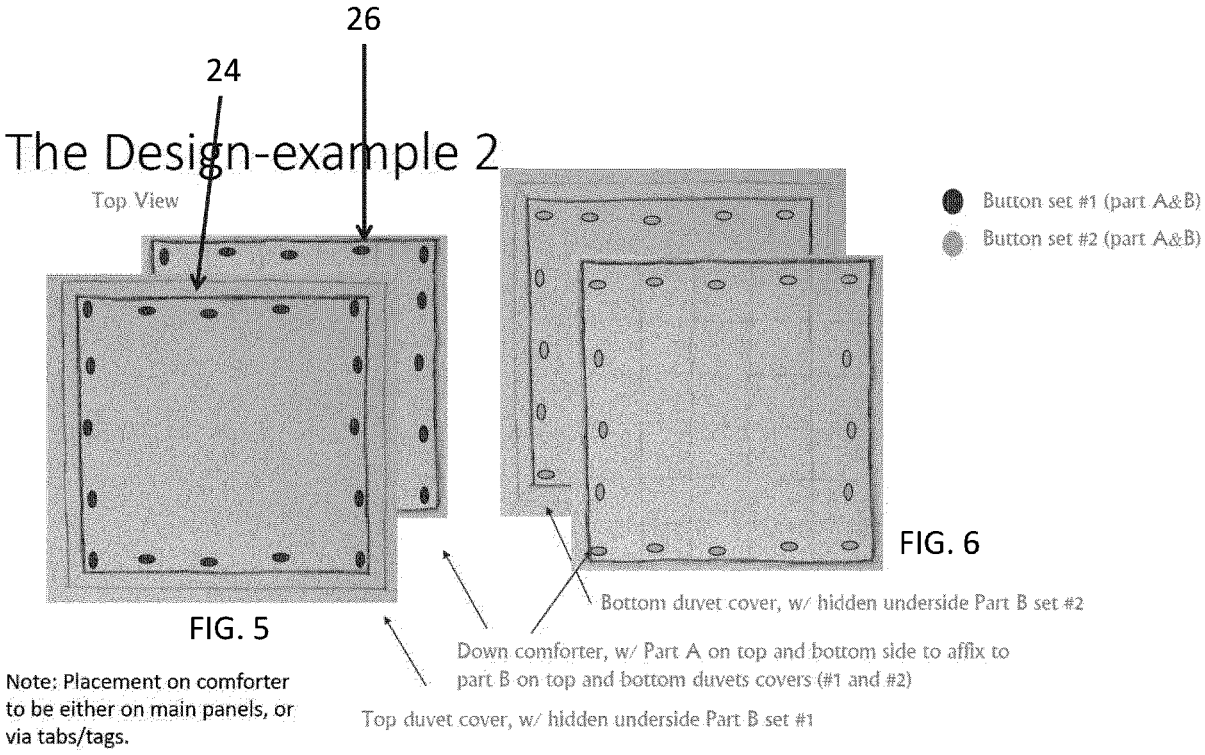
Note: Placement on comforter to be either on main panels, or via tabs/tags.

Note: Placement on comforter to be either on main panels, or via tabs/tags.

Note: Placement on comforter to be either on main panels, or via tabs/tags.

Note: Placement on comforter to be either on main panels, or via tabs/tags.

FIG. 16
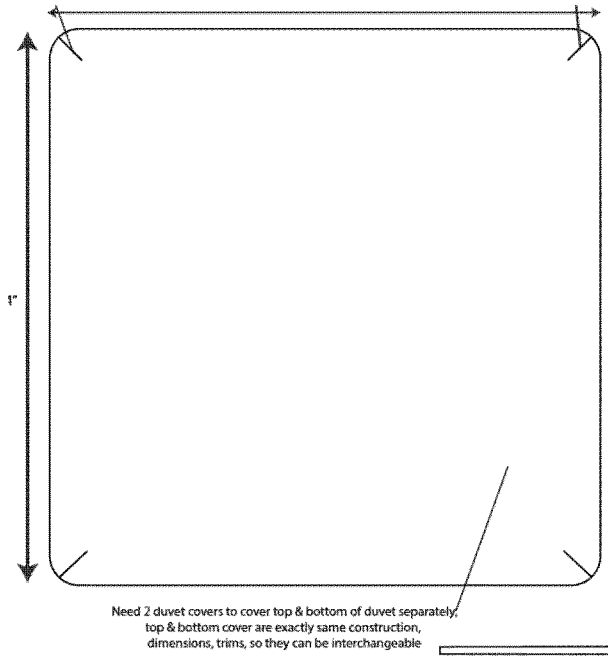
FIG. 17
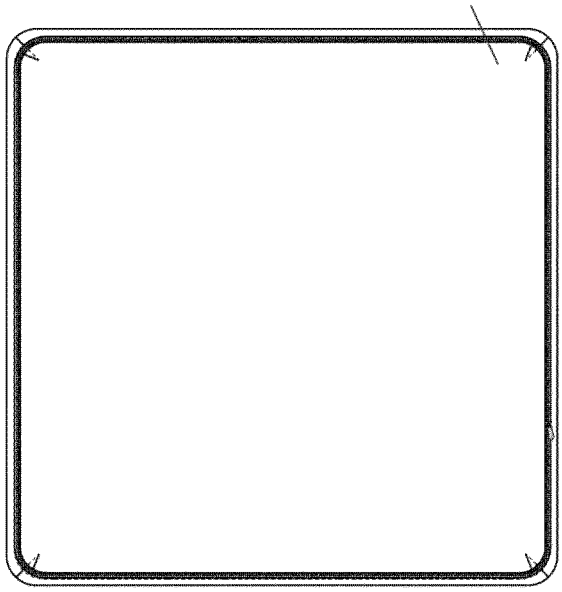
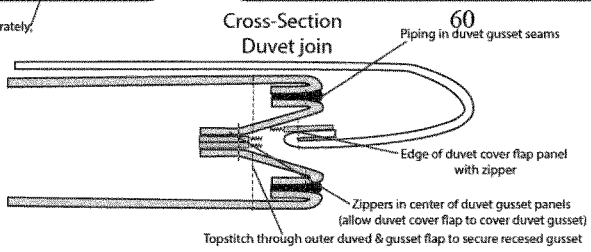
FIG. 18

DUVET AND DUVET COVER

CROSS-REFERENCE TO RELATED APPLICATIONS

This Application claims the benefit of and priority to U.S. Provisional Application No. 62/560399, filed Sep. 19, 2017, the entire contents of which are herein incorporated by reference.

STATEMENT REGARDING FEDERALLY SPONSORED RESEARCH

Not Applicable.

BACKGROUND OF THE INVENTION

It can be very difficult to change the duvet cover on a duvet comforter. Additionally, once the duvet cover is on, often shifting of the duvet inside occurs. What is needed is an improved duvet and duvet cover system to simplify the experience of changing the duvet cover, and to better hold the duvet secure within the duvet cover.

Without limiting the scope of the invention a brief summary of some of the claimed embodiments of the invention is set forth below. Additional details of the summarized embodiments of the invention and/or additional embodiments of the invention may be found in the Detailed Description of the Invention, below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

The inventive duvet and duvet cover system is a combination of a duvet with a separate top and bottom duvet cover layer, both of which are attached to the duvet around its perimeter within a recessed gusset, wherein the top and bottom layers of the duvet cover are not attached to each other, but only to the perimeter of the duvet.

The top and bottom duvet over layers can be attached using zipper's, hook and eye sets, snaps or tie sets.

Preferably separating zippers are used in the zipper embodiments. The zippers are arranged so the pull tabs are at opposite corners of a given duvet edge when fully zipped. The zippers may have rounded corners for ease of zipping, if desired.

The top and bottom covers can be constructed identically so they are interchangeable.

The top and bottom covers can have a border and/or a flap attached to the border, if desired.

Piping can be provided in the outer edges of the duvet gusset seams, if desired.

The top and bottom covers can have mitered corners or darts, if desired.

BRIEF DESCRIPTION OF THE DRAWINGS

FIG. 5 shows how the top cover attaches to the duvet with a button set.

FIG. 6 shows how the bottom cover attaches to the duvet with a button set.

FIG. 16 shows a top view of another embodiment of a duvet cover layer.

FIG. 17 shows a bottom view of another embodiment of a duvet cover layer.

FIG. 18 shows a cross-sectional view of the duvet join of FIGS. 16-17.

DETAILED DESCRIPTION OF THE INVENTION

Figures 1, 2:
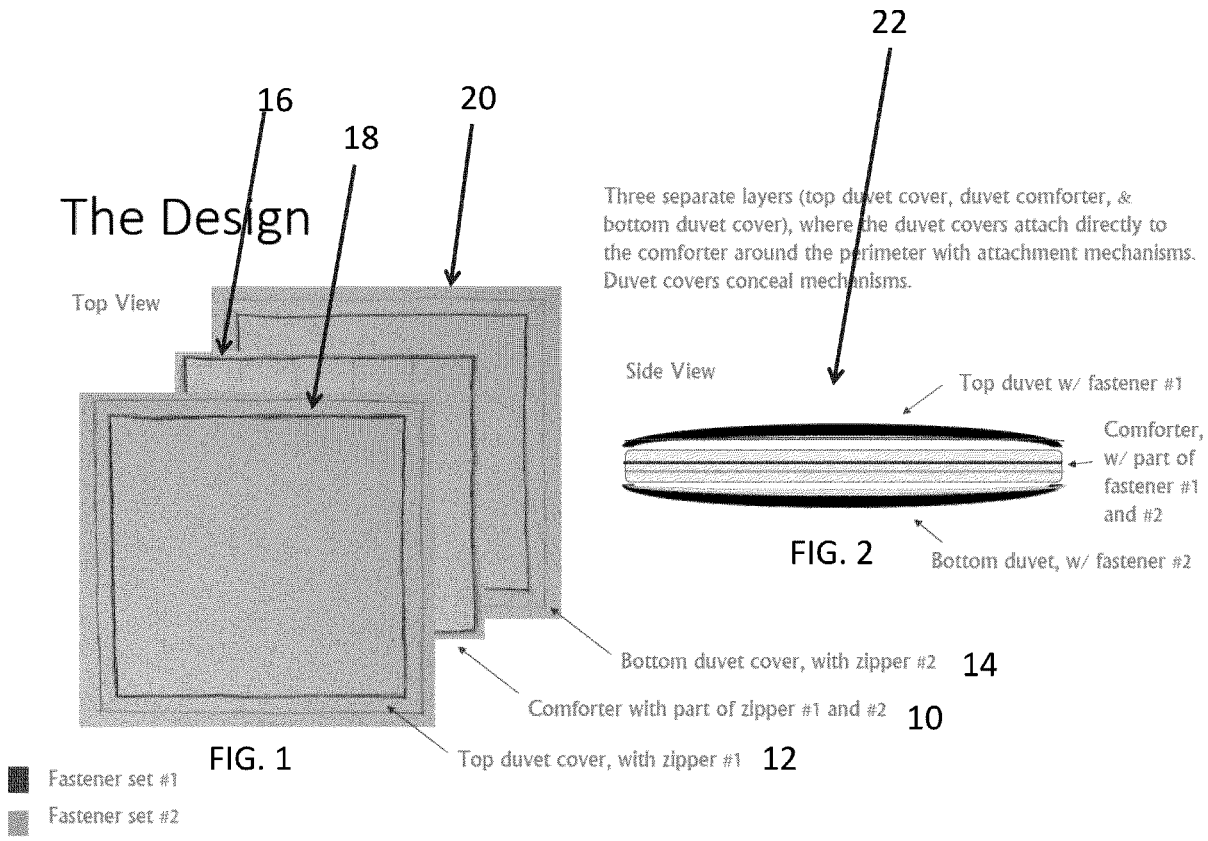
FIG. 1 shows an exploded view of the parts of a first embodiment of the duvet and duvet cover invention.
FIG. 2 shows how the parts of FIG. 1 are assembled.

While this invention may be embodied in many forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Referring to FIG. 1, an exploded view showing the parts of the duvet and duvet covers is shown in which the duvet or comforter is shown at 10, a top cover piece is shown at 12 and the bottom cover is shown at 14. Each of 10, 12 and 14 have a top side and a bottom side. The bottom side of the top cover 12 is attached to the top side of the duvet 10, while the bottom side of the duvet 10 is attached to the top (or interior) side of the bottom cover 14. In this embodiment the attachment mechanism is a pair of zippers, with one half of a zipper 18 connected to the bottom of the top cover 12 and the other half 16 of a zipper connected to the top side of the duvet 10. Similarly, one half of a zipper 20 is connected to the top side of the bottom cover 14 and the other half of the zipper (not shown in this figure) attached to the bottom side of the duvet 10.

Referring to FIG. 2, the assembled duvet with attached top and bottom covers is shown.

Figures 3, 4:
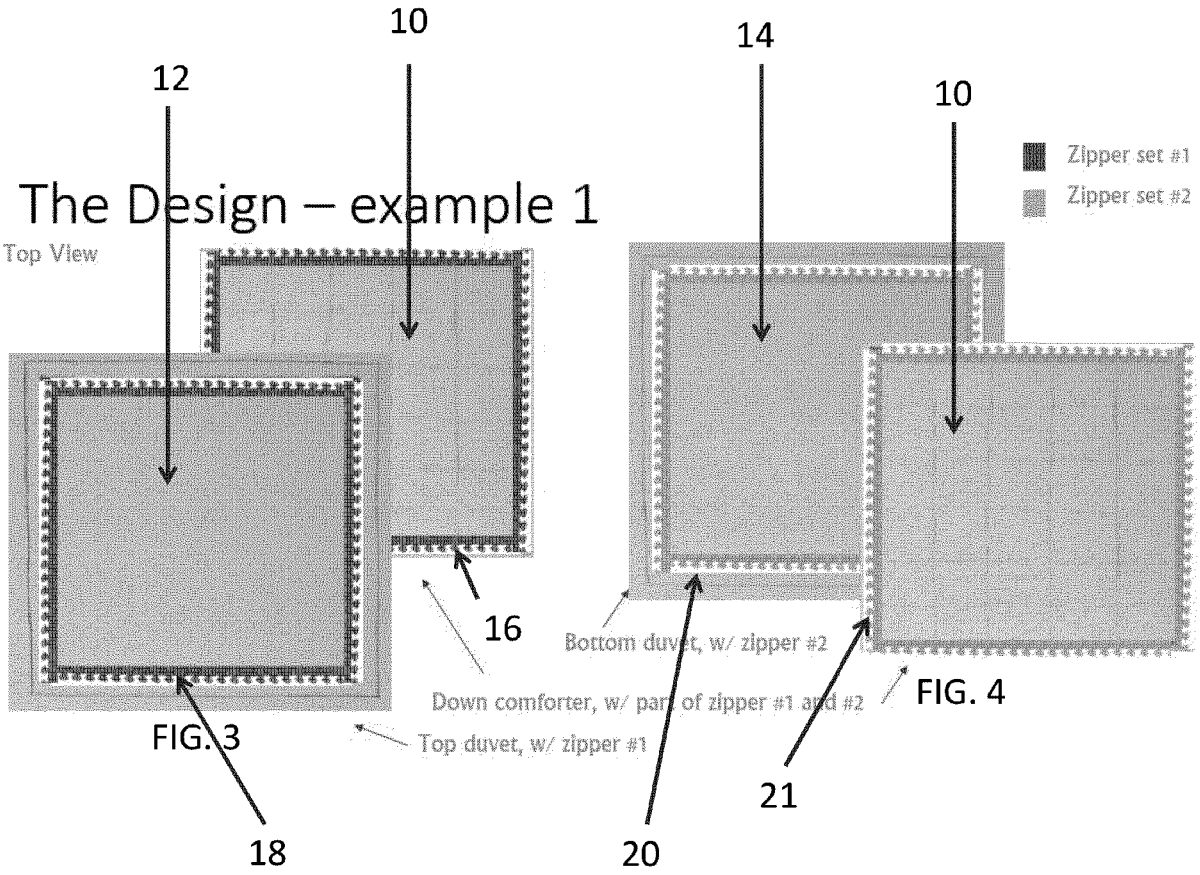
FIG. 3 shows how the top cover attaches to the duvet with a zipper set.
FIG. 4 shows how the bottom cover attaches to the duvet with a zipper set.

FIGS. 3-4 show the embodiment with zippers used to connect the top and bottom covers to the duvet. In this embodiment the attachment mechanism is a pair of zippers, with one half of a zipper 18 connected to the bottom of the top cover 12 and the other half 16 of a zipper connected to the top side of the duvet 10. Similarly, one half of a zipper 20 is connected to the top side of the bottom cover 14 and the other half of the zipper 21 is attached to the bottom side of the duvet 10.

FIGS. 5-6 show an embodiment with buttons used to connect the top and bottom covers to the duvet. In this embodiment a button set having parts A and B is used instead of zippers. Part A's 26 of the button set are attached to the top and bottom of the duvet 10, while the part B's 24 are connected to the bottom side of top cover 12 and the top side of the bottom cover 14.

Figures 7, 8:
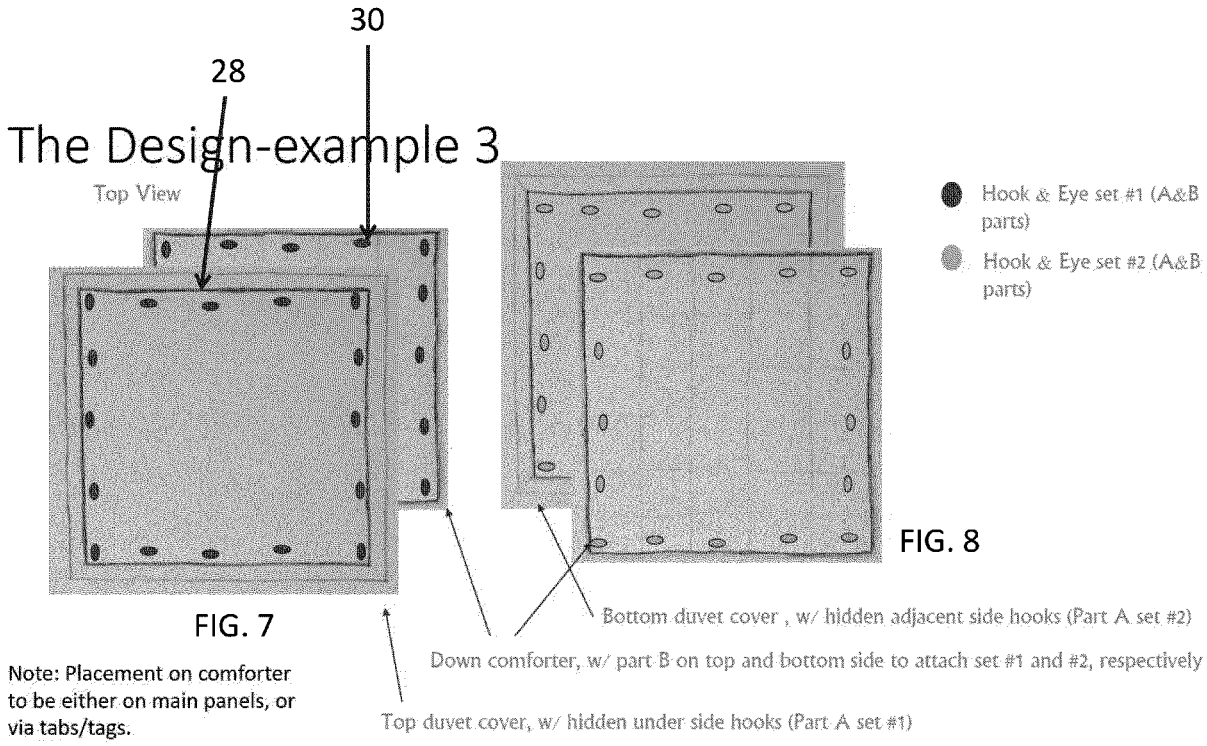
FIG. 7 shows how the top cover attaches to the duvet with a hook and eye set.
FIG. 8 shows how the bottom cover attaches to the duvet with a hook and eye set.

FIGS. 7-8 show an embodiment with hook and eye sets used to connect the top and bottom covers to the duvet. In this embodiment a hook and eye set having parts A and B is used instead of zippers. Part B's 30 of the hook and eye set are attached to the top and bottom of the duvet 10, while the part A's 28 are connected to the bottom side of top cover 12 and the top side of the bottom cover 14.

Figures 9, 10:
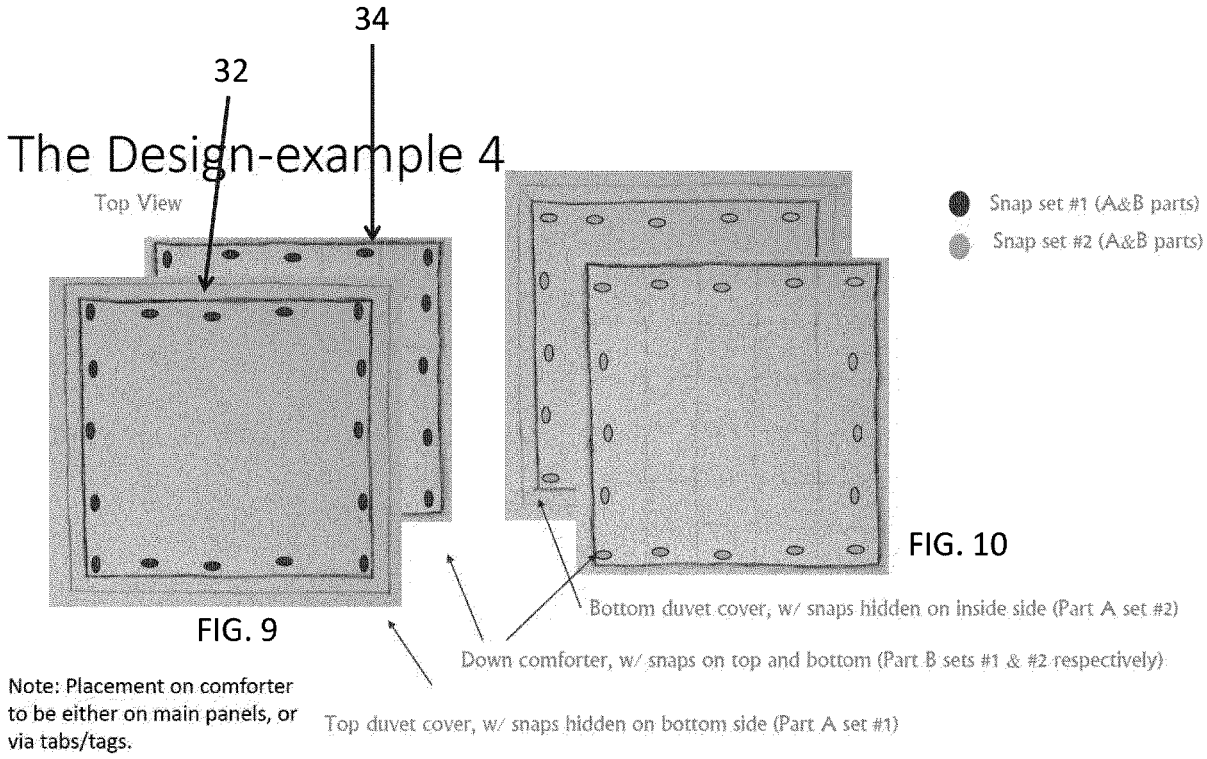
FIG. 9 shows how the top cover attaches to the duvet with a snap set.
FIG. 10 shows how the bottom cover attaches to the duvet with a snap set.

FIGS. 9-10 show an embodiment with snap sets used to connect the top and bottom covers to the duvet. In this embodiment a snap set having parts A and B is used instead of zippers. Part B's 34 of the snap set are attached to the top and bottom of the duvet 10, while the part A's 32 are connected to the bottom side of top cover 12 and the top side of the bottom cover 14.

Figures 11, 12:
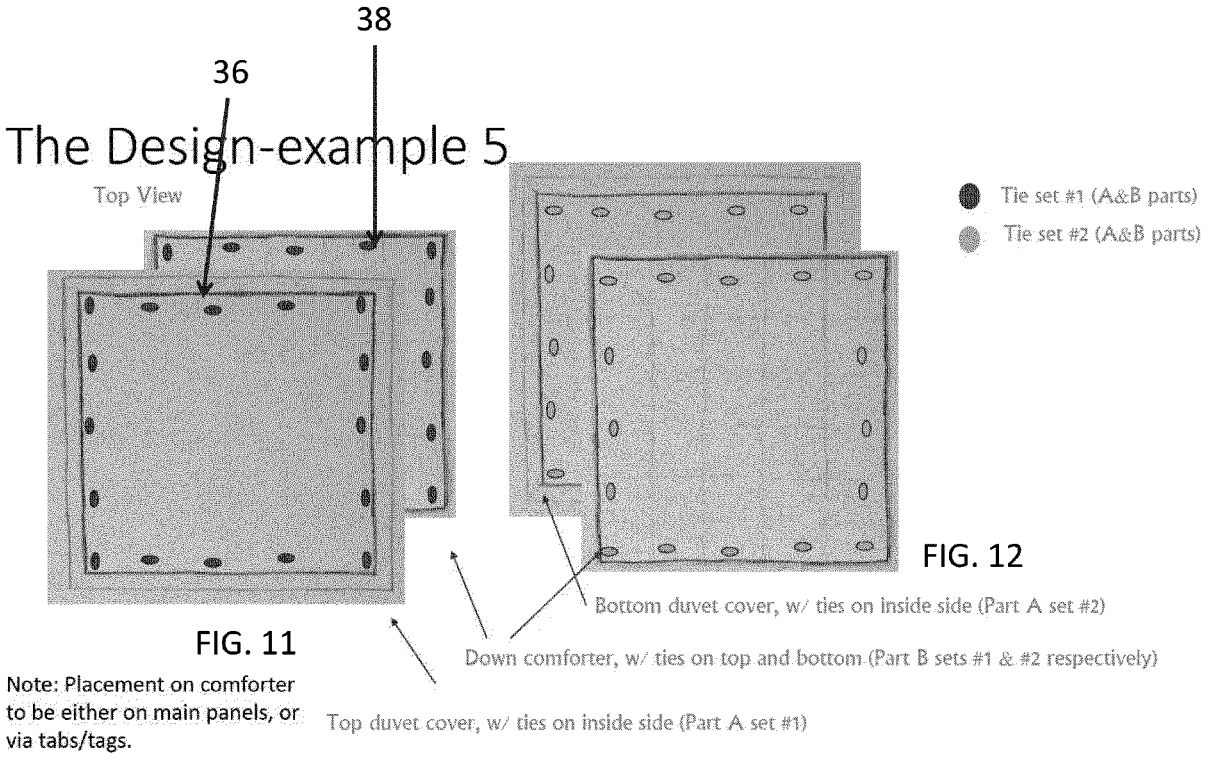
FIG. 11 shows how the top cover attaches to the duvet with a tie set.
FIG. 12 shows how the bottom cover attaches to the duvet with a tie set.

FIGS. 11-12 show an embodiment with tie sets used to connect the top and bottom covers to the duvet. In this embodiment a tie set having parts A and B is used instead of zippers. Part B's 38 of the tie set are attached to the top and bottom of the duvet 10, while the part A's 36 are connected to the bottom side of top cover 12 and the top side of the bottom cover 14.

Figure 13:
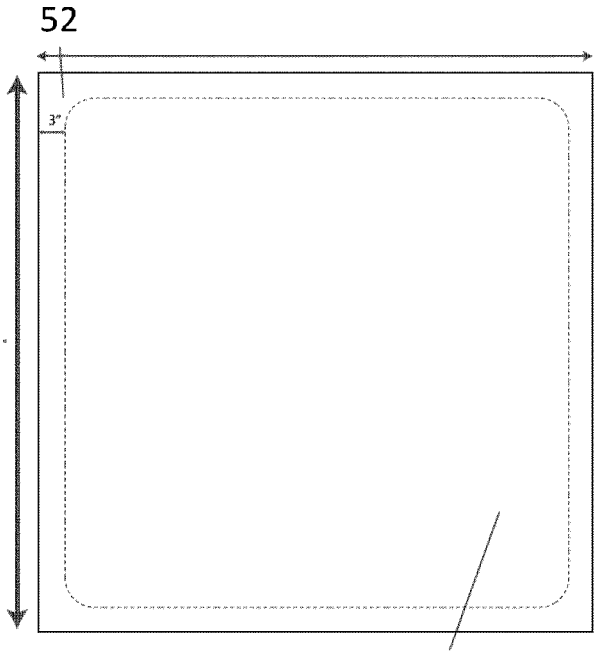
FIG. 13 shows a top view of another embodiment of a duvet cover layer.
Figure 14:
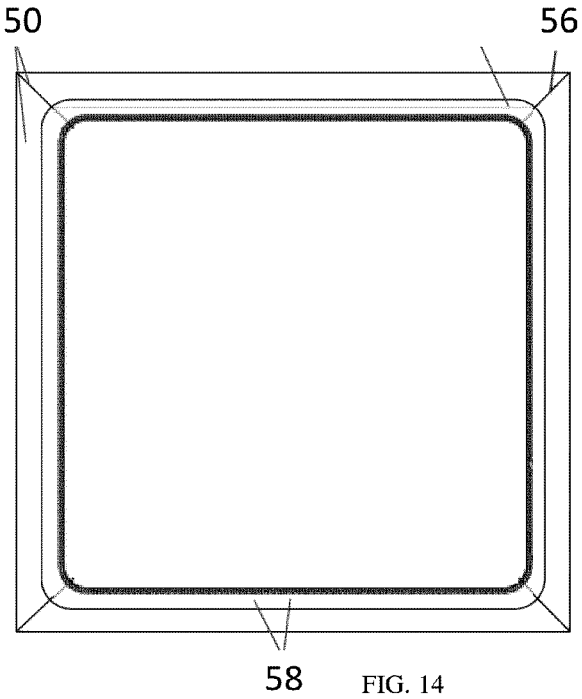
FIG. 14 shows a bottom view of another embodiment of a duvet cover layer.
Figure 15:
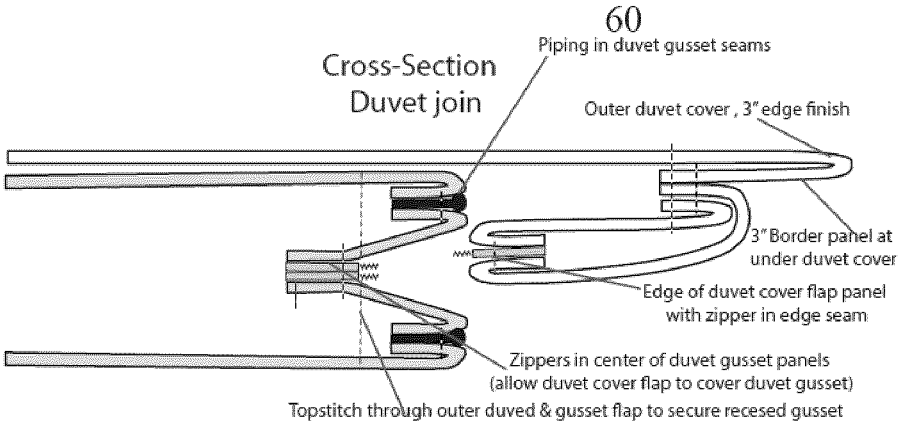
FIG. 15 shows a cross-sectional of the duvet join of FIGS. 13-14.

Referring to FIGS. 13-15, a top view (FIG. 13), bottom view (FIG. 14), and cross-section duvet join view (FIG. 16) are shown, of another embodiment. In this embodiment a three-inch folded border 50 is provided, with mitered corners 56 and a flap 58, which allows the duvet to lay flat and cover the zippers for added comfort. A 3 inch border topstitch 52 is provided on the top side. Piping 60 is provided in the duvet gusset seams. The seam on FIG. 13 is shown rounded off, but could be squared off, if desired. The zipper is shown on the inner seam under the flap, but could also be at the edge of the flap, as shown in FIG. 15.

Referring to FIGS. 16-18, a top view (FIG. 16), bottom view (FIG. 17), and cross-section duvet join view (FIG. 18) are shown, of another embodiment. In this embodiment the zipper is at the edge of the duvet and darts 62 are provided to conform the cover around curve of duvet edge. Piping 60 may optionally be provided in the duvet gusset seams.

Figure 19:
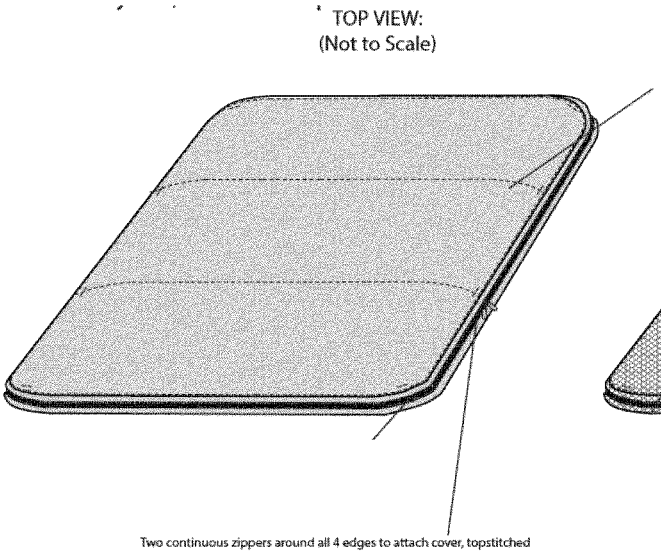
FIG. 19 shows a top view of the assembled product of FIGS. 16-18.
Figure 20:
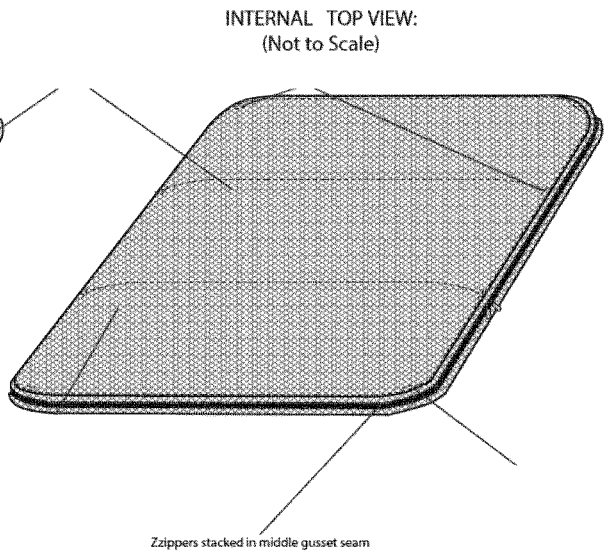
FIG. 20 shows an internal top view of the assembled product of FIG. 19.

FIGS. 19 and 20 show the top view and internal top view of the assembled product of the embodiment of FIGS. 16-18.

It should also be understood that the same three-part arrangement can be applied to a cover for a throw pillow.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A duvet cover in combination with a duvet, comprising:

a. a duvet with a duvet gusset seam, the duvet gusset seam having two attachment mechanisms embedded within the seam such that the two attachment mechanisms are positioned inward from an edge of the duvet and equal distance between a top surface of the duvet and a bottom surface of the duvet, the two attachment mechanisms extend around a perimeter of the duvet, a first of the two attachment mechanisms for use with a top duvet cover layer and a second of the two attachment mechanisms for use with a bottom duvet cover layer, where the attachment mechanisms for each of the top and bottom duvet cover layers are identical and placement is identical, each to its respective layer;

b. the top duvet cover layer of a duvet cover, which is attached around its perimeter over the top surface of the duvet, such that the perimeter extends into the duvet gusset and is concealed from an exterior of the duvet;

c. the bottom duvet cover layer of a duvet cover, which is attached around its perimeter over the bottom surface of the duvet, such that the perimeter extends into the duvet gusset and is concealed from an exterior of the duvet, wherein the top duvet cover layer and the bottom duvet cover layer of the duvet cover are not attached to each other; and wherein top duvet cover layer and the bottom duvet cover layer are identically constructed so as to be interchangeable and wherein the mechanism for attachment on the duvet cover layers are identically constructed so that the duvet cover layers are to be interchangeable for use as either the top or bottom layer.

2. The duvet cover in combination with a duvet of claim 1 wherein the two attachment mechanisms are zippers.

3. The duvet cover in combination with a duvet of claim 2 wherein the zippers is a separating zipper, so the top and bottom zippers may be detached from the top and bottom layers for ease of cleaning.

4. The duvet cover in combination with a duvet of claim 2 wherein a bottom side of the top and bottom layer has a border panel to which the zipper is attached.

5. The duvet cover in combination with a duvet of claim 1 wherein a top side of the top and bottom layer has a border topstitch.

6. The duvet cover in combination with a duvet of claim 2 wherein the top and bottom zippers have pull tabs and the top and bottom zippers are constructed and arranged so that the pull tabs are on opposite ends of a given edge when fully zipped.

7. A duvet cover in combination with a duvet of claim 1 wherein a bottom side of the top and bottom layer has mitered corners.

8. The duvet cover in combination with a duvet of claim 1 including piping arranged in a duvet gusset outer seam.

* * * * *